United States Patent [19]

Hashiyama et al.

[11] Patent Number: 4,939,551

[45] Date of Patent: Jul. 3, 1990

[54] CLEANING DEVICE FOR ELECTROPHOTOGRAPHIC COPYING MACHINES

[75] Inventors: Mitsuaki Hashiyama; Atsushi Inoue; Yoshio Yamada, all of Ibaraki, Japan

[73] Assignee: Toyo Tire & Rubber Company Limited, Osaka, Japan

[21] Appl. No.: 291,029

[22] Filed: Dec. 28, 1988

[30] Foreign Application Priority Data

Mar. 3, 1988 [JP] Japan ..... 63-50884

[51] Int. Cl.[5] ..... G03G 21/00

[52] U.S. Cl. ..... 355/299; 118/652

[58] Field of Search ..... 355/299, 302; 118/652

[56] References Cited

U.S. PATENT DOCUMENTS 3,950,206 4/1976 Adachi et al. ..... 428/409 X 4,255,044 3/1981 Cormier et al. ..... 355/299

4,576,468 3/1986 Saito ..... 355/299

FOREIGN PATENT DOCUMENTS 0055979 5/1981 Japan .

0192275 10/1984 Japan .

*Primary Examiner*—A. T. Grimley

*Assistant Examiner*—Robert Beatty

*Attorney, Agent, or Firm*—Armstrong, Nikaido, Marmelstein, Kubovcik & Murray

[57] ABSTRACT

In a cleaning device for an electrophotographic copying machine having a cleaning member unified in structure by bonding a blade member and a holding member together by an adhesive, the improvement characterized in that a heat-sensitive adhesive having a contact angle with water at 23° C. of 90° to 100° is used as the adhesive.

2 Claims, 2 Drawing Sheets

CLEANING DEVICE FOR ELECTROPHOTOGRAPHIC COPYING MACHINES

The present invention relates to a cleaning device for use in electrophotographic copying machines, facsimile devices, printers and the like to remove toner, developer and other materials remaining on an image bearing member, or to remove deposits on a recovery roll for recovering a toner on a fur brush.

In an electrophotographic copying machine or the like, a copy image is formed through use of a toner, and the toner remaining on the surface of an image bearing member is removed by a cleaning device.

The devices used for cleaning the image bearing member heretofore known include those of the fur brush type, magnetic brush type and blade type. These are used on electrophotographic copying machines, or the like, alone or in combination.

A process generally previously known for manufacturing a blade type cleaning device comprises preparing a blade by cutting a sheet-like elastomer, which is formed beforehand through centrifugal molding, cast molding and the like, into a specified size, and then bonding and fixing it to a holding member with use of an adhesive as shown in FIG. 1. The cleaning device is then brought into contact with an image bearing member, as shown in FIG. 2, to function as the means for removing residual toner and developer.

On the other hand, in the fur brush type, residual toner and developer on the image bearing member are removed by a fur brush 35, as shown in FIG. 3. The toner and developer thus removed are transferred onto a recovery roll 36, and deposits on the recovery roll, such as toner, developer and the like, are removed by a cleaning device 30 for the recovery roll. The cleaning device for the recovery roll consists of a blade member and a holding member, and is manufactured generally through a process substantially similar to that used to manufacture the blade type cleaning device used to clean the image bearing member.

A urethane elastomer is normally used for the blade, and the holding member consists of a rigid and elastic metal or plastic, ceramic and the like. However, a steel plate, which may be untreated, phosphated or chromated as a surface treatment, or otherwise plated, is normally used for the holding member.

A method for bonding the blade member and the holding member together by a two-sided adhesive tape is well known. However, the method does not satisfactorily ensure a bonding strength or adhesive property, particularly at high temperature, and when used on electrophotographic copying machines or the like as a cleaning device, the blade member and the holding member are capable of shifting or dislodging whereby causing defective cleaning. In the case of a cleaning device coming into contact with the image bearing member, it is known that a hot-melt adhesive, which is normally used, does not secure adhesion, and when working as a cleaning device, its durability is, as a practical matter, not sufficient. Therefore, a primer must be used together therewith.

Further, in a cleaning device coming into contact with an image bearing member, a bonding method, wherein various adhesives are used in two layers or more, with multicomponent adhesion or adhesive components of two kinds or more mixed together has been proposed (as disclosed in Unexamined Japanese Patent Publication No. 32079/1985) for enhancement of the adhesive property. However, the bonding process, or preparations of the adhesive, may take much time, or while working as a cleaning device, an interlayer separation of the adhesive may take place.

An object of the invention is to provide a cleaning device for electrophotographic copying machines or the like, wherein the described bonding process does not take a long time and good adhesion of the bonded layers is ensured.

The above and other objects of the invention will become apparent from the following description.

In a cleaning device for electrophotographic copying machines or the like having a composite cleaning member of unified structure comprising a blade member bonded to a holding member by means of an adhesive, the present invention provides an improvement characterized in that a heat-sensitive adhesive having a 90° to 100° contact angle with water at 23° C. is used.

According to the invention, it has been determined that use of the aforementioned specific adhesive is effective in enhancing the adhesion of the blade member and the holding member, increasing the durability of the cleaning device, and simplifying and facilitating the bonding process.

The adhesive used in the invention has a contact angle with water at 23° C. of 90° to 100° C. If the contact angle of the adhesive is less than 90° or more than 100°, it does not have sufficient adhesive strength, and thus, when the assembly is used as a cleaning device, its bonding strength is liable to deteriorate. The aforementioned adhesive is film-like of 30 to 200 μm, or preferable 50 to 160 μm, in thickness. Where the film thickness of adhesive is less than 30 μm, it is difficult to obtain a uniform film and thus, uniform adhesion, and the bonding strength also liable to deterioration. On the other hand, when the thickness is greater than 200 μm, the flow of the adhesive is hard to control at the time of melt adhesion, and the film may jut out whereby impairing its surface appearance. Polyester type adhesives PES-110 HEE, PES-111 EE, PES-120, etc. manufactured for example by Toa Gosei Chemical Industry Co., and synthetic rubber type adhesives NP 101 and others of Sony Chemical Co. are exemplary of preferred adhesives having a 90° to 100° contact angle. However, this invention is not limited to these specific examples.

As a blade member, an elastic material, which is plate-like, or almost plate-like, having a proper shape in section, such as a urethane elastomer, a fluorine-containing elastomer, a silicone type elastomer, or the like, is used for the invention. However, the urethane elastomer is preferable. The holding member used according to this invention includes rigid metals, elastomers, plastic elastomers, ceramics and the like. It is preferred to use a steel plate, particularly one which has been phosphated or chromated as a surface treatment, or otherwise plated, for example, with aluminum plate, and the like. According to the invention, known liquid primers may be used as the primer for the holding member as required. For example, polyamide, silicone, epoxy, chloroprene or acrylic primers may be used. Well-known means, such as hot plate, ultrasonic wave, high frequency induction, high frequency dielectric and microwave, may be selected for melting means in the invention. To attain high mounting precision, it is necessary that the blade member be kept from thermal deformation. Therefore, it is preferable that the holding member is heated an amount sufficient to melt the heat-sensitive adhesive before bonding it to the blade.

The cleaning device according to the invention ensures a high adhesive strength and durability of the blade member and holding member, and hence is capable of retaining a sufficient cleaning ability under various conditions. For increasing the adhesive strength, it is not necessary to use multiple layers of film nor to mix adhesive components of two or more kinds, and a primer need not necessarily be used, thus avoiding time for the preparation of the adhesive and also for the bonding process. The reason why the adhesive strength is high, and a sufficient cleaning ability can be retained under various conditions in the cleaning device of the invention, is not clear. However, it is possible that this may be related to the heat-sensitive adhesive of the invention having a uniform and satisfactory adhesive property with respect to both the holding member and blade member, and also to the adhesive strength substantially uniformly covering the overall bond surface.

The cleaning device of the invention, which has an outstanding effect as compared with the prior art cleaning devices, will be described more particularly with reference to Examples and Comparative Examples given below.

BRIEF DESCRIPTION OF THE DRAWINGS

FIG. 6 is a schematic drawing of the measuring of the contact angle of an adhesive.

Figure 1:
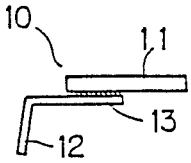
FIG. 1 is a schematic drawing of a cleaning device unified in structure through bonding a blade member and a holding member together by use of an adhesive.

In the cleaning device 10 shown in FIG. 1, the blade member 11 adheres to the holding member 12 by use of adhesive 13. In the cleaning device 20 of the counter system shown in FIG. 2 (*a*), the blade member 21 unified with the holding member 22, by use of the adhesive 23, comes in contact with the image bearing member 24 in a counter system. In the cleaning device 20 of the trailing system shown in FIG. 2 (*b*), the blade member 21 unified with the holding member 22, by use of the adhesive, comes in contact with the image bearing member 24 in trailing system.

The contact angle ($\theta$) is measured as follows with reference to FIG. 6. A drop of distilled water is placed on a sample film, composed of the adhesive material being measured and maintained horizontal. The water drop is observed in the horizontal direction from the side, and the angle ($\theta$) formed between the line a and the film f, as it is shown in FIG. 6, is measured at room temperature by use of a FACE contact angle meter CA DT·A. The contact angle ($\theta$) of the film is defined as twice ($\theta$).

Figure 3:
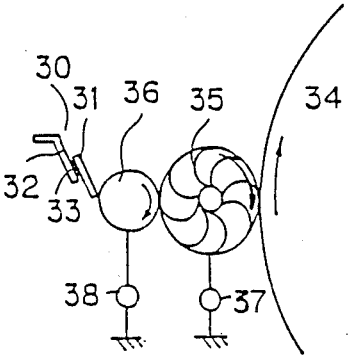
FIG. 3 is a schematic drawing of a fur brush type eliminator for toner on an image bearing member and a cleaning device for a recovery roller.
Figure 4:
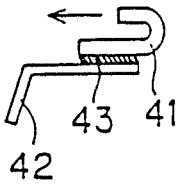
FIG. 4 is a schematic drawing of a 180° peeling strength test.

In the cleaning device 30 represented in FIG. 3, residual toner and the like on the image bearing member 34 are removed by a fur brush 35, the toner and the like thus removed are transferred onto a recovery roll 36, and the toner and the like on the recovery roll 36 are removed by a blade member 31 which is unified with a holding member 32 by use of an adhesive 33. In FIG. 4, a holding member 42 is fixed and the nose portion of a blade member 41, which is unified with the holding member 42 by use of an adhesive 43, is pulled in the direction indicated by an arrow, thereby measuring 180° peeling strength.

Figure 5:
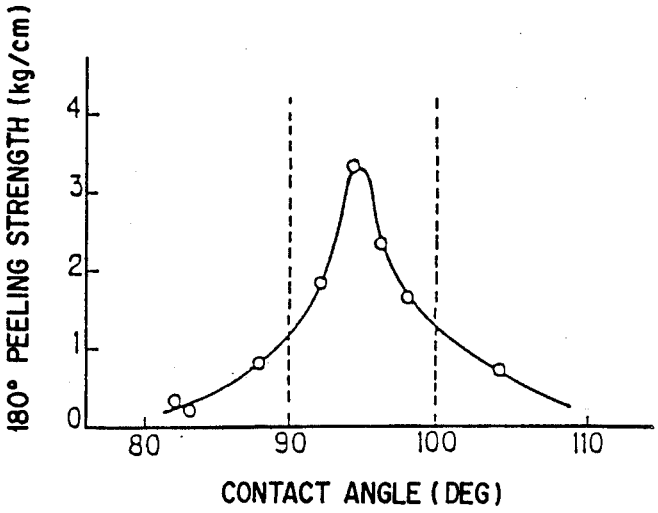
FIG. 5 is a graph showing the relation between the contact angle of a heat-sensitive adhesive and the 180° peeling strength thereof.

In FIG. 5, a satisfactory peeling strength is indicated by a contact angle of 90° to 100°.

EXAMPLES 1 to 4

A heat-sensitive, film-like adhesive having a contact angle of 90° to 100° was employed as the adhesive. A casting type polyurethane, 2 mm in thickness and having a JIS A hardness of 70, was employed as the rubber elastomer used as the blade member. A zinc-plated iron plate (manufactured by Nippon Steel Corporation; BONDE) having its surface phosphated, was used for the holding member. The bond area of the blade member and the holding member was 10 mm wide and 320 mm long. For bonding, a film of adhesive was first put on the bond area of the blade member, and then set so as to comply with the bond area of the holding member. The assembly was subjected to a hot-melt adhesion on a hot press, thus obtaining a cleaning device according to this invention. FIG. 1 shows the construction thereof.

In order to determine the adhesive strength of the cleaning device, a holding member 42 was fixed, as shown in FIG. 4, and pulled in the direction, indicated by an arrow, with a nose portion of the blade member retained by an air chuck, thereby measuring its 180°. peeling strength. The result is shown in Table 1.

Then, the contact angle of the adhesive with water was measured at room temperature by means of a FACE contact angle meter CA-DT·A, manufactured by Kyowa Kaimen Kagaku K.K. Further, to test the adhesion, a sample prepared therefor was allowed to stand for 48 hours at room temperature and then subjected to measurement of the peeling strength at room temperature.

COMPARATIVE EXAMPLES 1 TO 4

A cleaning device was obtained in the same manner as in the above Examples, by means of a heat-sensitive film-like adhesive with a contact angle less than 90° or greater than 100°, and was subjected to the measurement of its peeling strength. The results are shown in Table 1.

COMPARATIVE EXAMPLE 5

A cleaning device was obtained by means of an adhesive tape and subjected to measurement of its peeling strength. The results are also shown in Table 1.

TABLE 1

| | Contact Angle | Adhesive | Film Thickness (μm) | 180° Peeling Strength (kg/cm) |
|---|---|---|---|---|
| Example 1 | 92° | A | 150 | 1.8 |
| Example 2 | 94° | B | 150 | 3.3 |
| Example 3 | 96° | C | 160 | 2.3 |
| Example 4 | 98° | D | 150 | 1.6 |
| Comparative Example 1 | 82° | E | 150 | 0.3 |
| Comparative Example 2 | 83° | F | 150 | 0.2 |
| Comparative Example 3 | 88° | G | 140 | 0.8 |
| Comparative Example 4 | 104° | H | 100 | 0.7 |

TABLE 1-continued

| | Contact Angle | Adhesive | Film Thickness (μm) | 180° Peeling Strength (kg/cm) |
|---|---|---|---|---|
| Comparative Example 5 | — | I | — | 0.5 |

A: Polyester film adhesive, Toa Gosei Chemical Industry Co., Ltd., PES-110 HEE
B: Polyester film adhesive, Toa Gosei Chemical Industry Co., Ltd., PES-111 EE
C: Polyester film adhesive, Toa Gosei Chemical Industry Co., Ltd., PES-120
D: Synthetic rubber film adhesive, Sony Chemical Co., Ltd., NP 101
E: Polyamide film adhesive, Daicel Chemical Industry., Ltd, Daiamide 4100
F: Polyurethane film adhesive, Asahi Glass Co., Ltd., F601
G: Polyester film adhesive, Nippon Matai Co., Ltd., PH 413
H: Synthetic rubber film adhesive, Nitto Electric Ind. Co., Ltd., M 5257
I: Adhesive tape, Nitto Electric Ind. Co., Ltd., No. 500

From Table 1, it can be seen that satisfactory adhesive strength is only indicated in the Examples wherein the contact angle of the adhesive was 90° to 100°. The peeling strength was subject to deterioration, in Comparative Examples 1 to 3, wherein the contact angle of the adhesive was less than 90°. Further, even where (Comparative Example 4) the contact angle was greater than 100°, the peeling strength deteriorated. This is easy to understand by showing a relation between peeling strength and contact angle of the adhesive, as shown in FIG. 5, and a satisfactory peeling strength is indicated with a contact angle of 90° to 100°.

The Examples show a substantially higher peeling strength as compared with Comparative Example 5, wherein a conventional adhesive tape was used.

EXAMPLES 5 TO 8

Next, to examine the influence exerted by the thickness of the adhesive, cleaning devices, using adhesive films of 40, 60, 150, 180 μm in thickness, were prepared as in the case of Examples 1 to 4 by use of an adhesive (PES-120, Toa Gosei Chemical Industry Co.) having a contact angle of 96°, thereby to measure the peeling strength. The results are shown in Table 2.

COMPARATIVE EXAMPLES 6 AND 7

With an adhesive thickness of 20 μm (Comparative Example 6) and 240 μm (Comparative Example 7), cleaning devices were prepared as in the case of Examples 5 to 8 by use of the same adhesive as Examples 5 to 8, and then measuring the peeling strength thereof. The results are shown in Table 2.

TABLE 2

| | Thickness of adhesive (μm) | Peeling strength (kg/cm) | Remarks |
|---|---|---|---|
| Com. Ex. 6 | 20 | 1.1 | Dispersion heavy in peeling strength |
| Ex. 5 | 40 | 1.9 | Good in appearance |
| Ex. 6 | 60 | 2.3 | Good in appearance |
| Ex. 7 | 150 | 2.4 | Good in appearance |
| Ex. 8 | 180 | 2.4 | Adhesive jutting out somewhat |
| Com. Ex. 7 | 240 | 2.6 | Adhesive jutting out very much |

TABLE 2-continued

According to Table 2, the thicker the adhesive is, the greater the peeling strength becomes, becoming almost constant at around 50 μm. In case the adhesive is extremely thin, as shown in Comparative Example 6, not only the peeling strength becomes low, but also a dispersion of the peeling strength is intensified. The reason may be that the thin film is not uniform in most cases. Then, where the adhesive is so thick, like Comparative Example 7, the adhesive excessively juts out of the bond surface at the time of pressure melt, thus resulting in an uneven adhesion and also in a poor appearance. Accordingly, the adhesive is preferable 30 to 200 μm, and more preferable 50 to 160 μm, in thickness.

EXAMPLES 9 TO 12

A heat-sensitive film-like adhesive, (PES-111 EE, 150 μm thick, manufactured by Toa Gosei Chemical Industry Co.) having a contact angle of 94°, was used for the adhesive, and a casting type polyurethane, 1.5 mm in thickness and 77 of JIS A hardness, was used for the rubber elastomer blade member. Cleaning devices were prepared, as in the case of Examples 1 to 4, by use of a galvanized sheet iron (Example 9) having a phosphated surface, a galvanized sheet iron (Example 10) having a chromated surface, a sheet iron (Example 11) having a galvanized black surface, and an aluminum plate (Example 12) for the holding member, and the 180° peeling strength was measured. The results are shown in Table 3.

TABLE 3

| | Example 9 | Example 10 | Example 11 | Example 12 |
|---|---|---|---|---|
| Kind of holding member | Galvanized, sheet iron, phosphated | Galvanized sheet iron, chromated | Sheet iron galvanized black | Aluminum plate |
| Primer for holding member | None | None | Chlorinated rubber | Polyvinyl butyral |
| 180° Peeling strength (kg/cm) | 3.5 | 3.2 | 5.1 | 3.4 |

A high peeling strength is indicated by all of the Examples given in Table 3, and it is apparent that a sheet iron having a phosphated or chromated surface, a galvanized sheet iron of an aluminum plate can be used for the holding member, and a primer, for the holding member, may properly be selected to use in the invention.

EXAMPLE 13

Figure 2A:
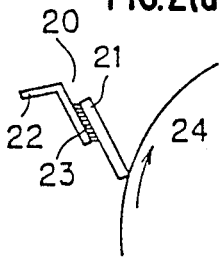
FIGS. 2(*a*) and (*b*) are schematic drawings representing a mode wherein the cleaning device comes in contact with an image bearing member in a counter system and a trailing system respectively.
Figure 2B:
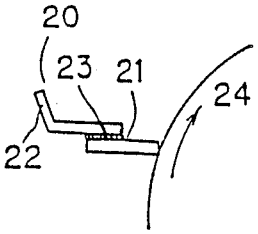

A cleaning device for removing residual toner on an image bearing member of an electrophotographic copying machine was prepared, as shown in FIG. 2, by using a heat-sensitive film-like adhesive (PES-110 HEE by Tao Gosei Chemical Industry Co.) 100 μm in thickness and having a contact angle of 92° as the adhesive, a casting type polyurethane, 70 of JIS A hardness and 2 mm in thickness as the blade member, and an aluminum plate, with a polyvinyl butyral primer applied thereon, as the holding member. The device was installed on an electrophotographic copying machine on the market and subjected to a test. As a result, no abnormality was observed with respect to its adhesive property under various environmental conditions, such as low temperature and low humidity (5° C. and 30%, respectively), high temperature and high humidity (35° C. and 85%, respectively) as well as room temperature, and thus, satisfactory cleaning ability was obtained.

EXAMPLE 14

A cleaning device for a toner recovery roll of an electrophotographic copying machine was prepared, as shown in FIG. 3, by using a heat-sensitive film-like adhesive, (PES-111 EE by Toa Gosei Chemical Industry Co.) 150 μm in thickness and having a contact angle of 94° as the adhesive, a casting type polyurethane, having a JIS A hardness of 80 and 1.5 mm in thickness, as the blade member, and a galvanized sheet iron, having its surface phosphated, as the holding member. The device was installed on an electrophotographic copying machine on the market and subjected to a test. As a result, no abnormality was observed in adhesive property under various environmental conditions such as room temperature, low temperature and low humidity (5° C. and 30%, respectively), high temperature and high humidity (35° C. and 85%, respectively) and the like, thus functioning satisfactorily as a cleaning device for the toner recovery roll.

The cleaning device of the invention unified in substructure through bonding the blade member and the holding member together by means of a heat-sensitive adhesive having a contact angle of 90° to 100° provides high adhesive strength and durability, ensures a sufficient cleaning ability under various environmental conditions, and simplifies and facilitates the adhesive process.

We claim:

1. A cleaning device for an electrophotographic copying machine having a structurally unified cleaning member comprising a blade member and a holding member bonded together by a heat-sensitive adhesive having a contact angle with water at 23° C. of 90° to 100°.

2. The cleaning device for an electrophotographic copying machine as defined in claim 1, wherein the heat-sensitive adhesive is in the form of film 30 to 200 μm thick.

* * * * *